US009573189B2

(12) United States Patent
Niitsuma et al.

(10) Patent No.: US 9,573,189 B2
(45) Date of Patent: Feb. 21, 2017

(54) SUBMERGED NOZZLE FOR CONTINUOUS CASTING APPARATUS

(71) Applicant: SHINAGAWA REFRACTORIES CO., LTD., Tokyo (JP)

(72) Inventors: Hiroyasu Niitsuma, Tokyo (JP); Yukio Okawa, Tokyo (JP); Hidetaka Ogino, Tokyo (JP); Shinsuke Inoue, Tokyo (JP)

(73) Assignee: SHINAGAWA REFRACTORIES CO., LTD., Tokyo (JP)

( * ) Notice: Subject to any disclaimer, the term of this patent is extended or adjusted under 35 U.S.C. 154(b) by 213 days.

(21) Appl. No.: 14/389,900

(22) PCT Filed: Apr. 11, 2013

(86) PCT No.: PCT/JP2013/060963

§ 371 (c)(1),
(2) Date: Oct. 1, 2014

(87) PCT Pub. No.: WO2013/161578

PCT Pub. Date: Oct. 31, 2013

(65) Prior Publication Data

US 2015/0068701 A1 Mar. 12, 2015

(30) Foreign Application Priority Data

Apr. 26, 2012 (JP) ..... 2012-100656
Dec. 20, 2012 (JP) ..... 2012-277843

(51) Int. Cl.
*B22D 41/50* (2006.01)
*B22D 11/114* (2006.01)
*B22D 11/103* (2006.01)

(52) U.S. Cl.
CPC ..... *B22D 11/114* (2013.01); *B22D 11/103* (2013.01); *B22D 41/507* (2013.01)

(58) Field of Classification Search
CPC ..... B22D 41/507; B22D 41/50
USPC ..... 222/606, 607
See application file for complete search history.

(56) References Cited

U.S. PATENT DOCUMENTS

2015/0068701 A1* 3/2015 Niitsuma ..... B22D 41/507 164/439

FOREIGN PATENT DOCUMENTS

| | | |
|---|---|---|
| JP | 58-77754 | 5/1983 |
| JP | 58-112641 | 7/1983 |
| JP | 62-270260 | 11/1987 |
| JP | 10-113753 | 5/1998 |

(Continued)

OTHER PUBLICATIONS

Extended European Search Report issued Nov. 10, 2015 in corresponding European patent application No. 13780562.

(Continued)

*Primary Examiner* — Scott Kastler
(74) *Attorney, Agent, or Firm* — Wenderoth, Lind & Ponack, L.L.P.

(57) ABSTRACT

A submerged nozzle for continuous casting of molten metal, wherein two or more discharge hole flow passages are provided on a cylindrical side surface of a submerged nozzle, and first and second inner surface side walls and first and second outer surface side walls of the discharge hole flow passages in a horizontal cross-section of the submerged nozzle when in use are composed by straight lines formed so as to be inflected at an inner side point of inflection and an outer side point of inflection.

8 Claims, 8 Drawing Sheets

(56) References Cited

FOREIGN PATENT DOCUMENTS

| | | |
|---|---|---|
| JP | 11-104794 | 4/1999 |
| JP | 2005-28385 | 2/2005 |
| SU | 1 565 573 | 5/1990 |

OTHER PUBLICATIONS

International Search Report issued Jul. 16, 2013 in International Application No. PCT/JP2013/060963.

* cited by examiner

SUBMERGED NOZZLE FOR CONTINUOUS CASTING APPARATUS

TECHNICAL FIELD

The present invention relates to a submerged nozzle for a continuous casting apparatus, and particularly to a submerged nozzle used in a continuous casting apparatus which continuously produces cast steel products, such as slabs, blooms, billets, and the like, from molten steel, and more particularly to a submerged nozzle which contributes to improvement in the quality of a cast metal by generating a stable rotational flow of molten steel inside a mold.

BACKGROUND ART

In general, a submerged nozzle is widely used in continuous casting equipment, in order to introduce molten steel from a tundish into a mold. The submerged nozzle has a role of preventing re-oxidation of the molten steel due to direct contact with the atmosphere, and is an important refractory which makes a great contribution to improving the quality of the cast metal.

Furthermore, the flow of the molten steel discharged into the mold from the submerged nozzle affects the quality of the cast metal. For example, in rectangular molds, such as blooms, billets, or the like, it is important to supply as uniform a discharge flow as possible, at each of the mold surfaces, in order to prevent cracks in the cast metal. On the other hand, the surface quality of the cast metal is also improved by rotating and churning the molten steel inside the mold, since inclusions and air bubbles become less liable to be captured in the solidification shell.

A known method for churning the cast steel inside the mold, for example, is to provide an electromagnetic stirring device in the vicinity of the mold, and to use electromagnetic forces to churn the molten steel. However, since an electromagnetic stirring device is extremely expensive, there have been demands to carry out churning by an alternative, inexpensive system.

As a method for this, it has been attempted to create a rotational flow inside the mold by means of the discharge flow from a submerged nozzle, thereby churning the molten steel.

For example, Patent Document 1 proposes a method for obtaining a rotational flow by discharging a discharge flow in a tangential direction at a plurality of positions which are symmetrical with respect to the center of the discharge, and at an angle of 45±10° with respect to the square mold surface. Furthermore, it has also been proposed to form the discharge holes with a straight shape or curved shape.

Moreover, Patent Document 2 proposes a nozzle in which a portion of the inner wall of a discharge hole coincides with the tangent to the inner circumference of the nozzle.

Furthermore, Patent Document 3 proposes a method using a nozzle wherein the direction of discharge from a discharge hole is formed at an angle in the circumferential direction with respect to a radiating direction from the center, in such a manner that the submerged nozzle receives a reactive force produced when the molten steel is discharged, thereby causing the submerged nozzle itself to rotate about a perpendicular axis and hence causing the flow of molten steel flow to rotate.

Moreover, Patent Document 4 proposes a method wherein a discharge hole is arranged at an inclination to the radiating direction, the submerged nozzle is divided into two parts, an upper and a lower part, and the lower nozzle is caused to rotate about a perpendicular axis.

Patent Document 1: Japanese Patent Application Publication No. S58-77754

Patent Document 2: Japanese Patent Application Publication No. S58-112641

Patent Document 3: Japanese Patent Application Publication No. S62-270260

Patent Document 4: Japanese Patent Application Publication No. H10-113753

DISCLOSURE OF THE INVENTION

Since a conventional submerged nozzle for continuous casting of molten metal is constituted as described above, the following problems exist.

More specifically, in the case of Patent Documents 1 and 2 described above, experimental results indicate that although a rotational flow is obtained, a stable rotational flow is not achieved, but rather the rotational flow repeatedly appears and disappears.

Furthermore, in the case of the configuration in Patent Document 3 described above, a structure which contacts via a metal component a bearing via a metal component is adopted in such a manner that the submerged nozzle can rotate readily, and there is a problem with the sealing properties of the connecting refractories.

Moreover, in any of Patent Documents 1 to 4 described above, with the structures proposed in the prior art, the rotational flow is instable, the flow rate is slow, and sufficient beneficial effects are not obtained in terms of preventing the capture of inclusions and air bubbles in the solidification shell. Furthermore, beneficial effects are not obtained with respect to castings having a circular cross-section, such as a circular billet.

The present invention was devised in order to resolve the problems described above, an object thereof being to provide a submerged nozzle wherein two or more discharge hole flow passages are provided on a round cylindrical side surface of a submerged nozzle, and the inner and outer surface side walls of the discharge hole flow passages in a horizontal cross-section of the submerged nozzle when in use are constituted by an inflected straight line, whereby a stable rotational flow is generated in the molten steel inside the mold, thereby contributing to improvement in the quality of the cast metal.

In the submerged nozzle for continuous casting of molten metal according to the present invention, two or more discharge hole flow passages are provided on a cylindrical side surface of a submerged nozzle having a nozzle hole, and first and second inner surface side walls and first and second outer surface side walls of the discharge hole flow passages in a horizontal cross-section of the submerged nozzle when in use are composed by straight lines formed so as to be inflected at an inner side point of inflection and an outer side point of inflection; a first angle, which is formed between a straight line that links a first and a second intersection point where an outer edge of the nozzle hole intersects with two straight lines formed by the first inner surface side wall and the first outer surface side wall on the inner side of the discharge hole flow passages of the submerged nozzle, and a first center line which intersects with the straight line and passing through a hole center of the nozzle hole, is 45 to 135°; and when a thickness of the submerged nozzle is t, a distance from the hole center of the nozzle hole to the inner side point of inflection is a, a distance from the hole center to the outer side point of inflection is b, and ri is the radius of the nozzle hole, then $$0.2 \geq (a-ri)/t \text{ and } (b-ri)/t \geq 0.9$$

are established.

Furthermore, a circular or polygonal bottom hole is provided in a nozzle bottom of the submerged nozzle, and if an opening surface area of the bottom hole is represented by $S_b$, and a total opening surface area which is the sum of an opening surface area of the discharge hole flow passages and the opening surface area of the bottom hole is represented by $S_t$, and a total opening surface area which is the sum of an opening surface area of the discharge hole flow passages (2) and the opening surface area of the bottom hole (17) is $S_t$ then $S_b/S_t$ is 0 to 0.4 is established.

Since the submerged nozzle for continuous casting of molten metal according to the present invention is composed as described above, the following beneficial effects can be achieved.

More specifically, by adopting a composition wherein two or more discharge hole flow passages are provided on a cylindrical side surface of a submerged nozzle having a nozzle hole, and a first and a second inner surface side wall and a first and a second outer surface side wall of the discharge hole flow passages in a horizontal cross-section of the submerged nozzle when in use are composed by straight lines formed so as to be inflected at an inner side point of inflection and an outer side point of inflection, it is possible to contribute to improvement of the quality of the cast metal, by generating a stable rotating flow of molten steel inside a mold simply by improving the shape of the discharge holes of the submerged nozzle, without making modifications to other equipment.

BEST MODE FOR CARRYING OUT THE INVENTION

It is an object of the present invention to provide a submerged nozzle for continuous casting of molten metal whereby a stable rotational flow of molten steel is generated inside a mold, thus contributing to improvement in the quality of the cast metal.

Practical Examples

A preferred embodiment of a submerged nozzle for continuous casting of molten metal according to the present invention is described below with reference to the drawings.

Firstly, the process leading up to the development of the submerged nozzle for continuous casting of molten metal according to the present invention will be explained.

In general, in order to obtain a stable rotational flow inside the mold without applying modifications to the manufacturing equipment, not to mention an electromagnetic churning apparatus, there are two important points: that the discharge flow which flows out from the submerged nozzle via the discharge hole (1) should be inclined by a prescribed amount with respect to the radiating direction viewed from the central axis of the submerged nozzle, and (2) should continue in a stable state as described above. Various discharge hole shapes were studied from this perspective, and respective hole shapes were assessed by carrying out water model experiments, leading to the development of the submerged nozzle according to the present invention.

A water model of the submerged nozzle was a water model envisaging a continuous casting apparatus for 200 mm-diameter round billet, wherein the submerged nozzle has an inner diameter of 35 mm, an outer diameter of 75 mm, a material thickness of 20 mm, an output cross-section of the discharge hole of 24 mm×22 mm, four discharge holes, and a casting draw rate of 2.0 m/minute.

Figure 11:
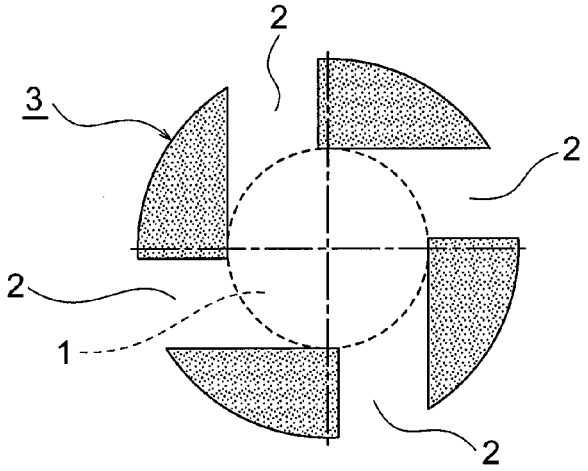
FIG. 11 (PRIOR ART)
FIG. 11 is a schematic drawing showing a conventional shape where discharge hole flow passages are provided in a tangential direction to the nozzle hole (Patent Documents 1 to 4)
Figure 12:
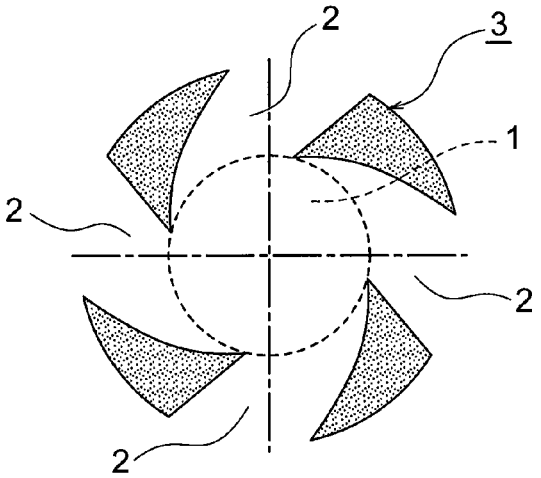
FIG. 12 (PRIOR ART)
FIG. 12 is a schematic drawing showing a conventional shape where discharge hole flow passages are provided in a tangential direction to the nozzle hole (Patent Documents 1 and 3)

Firstly, as shown in FIG. 11, investigation was carried out into whether or not a rotational flow is generated by using a shape in which the nozzle hole 1 is provided with discharge hole flow passages 2 in the tangential direction as in Patent Documents 1 to 4, and by using a curved shape which is provided with discharge hole flow passages 2 in the tangential direction of the nozzle hole 1 as indicated in Patent Documents 1 and 3 and shown in FIG. 12, but although a rotational flow was obtained, a stable rotational flow was not achieved and the rotational flow repeatedly appeared and disappeared.

Figure 2:
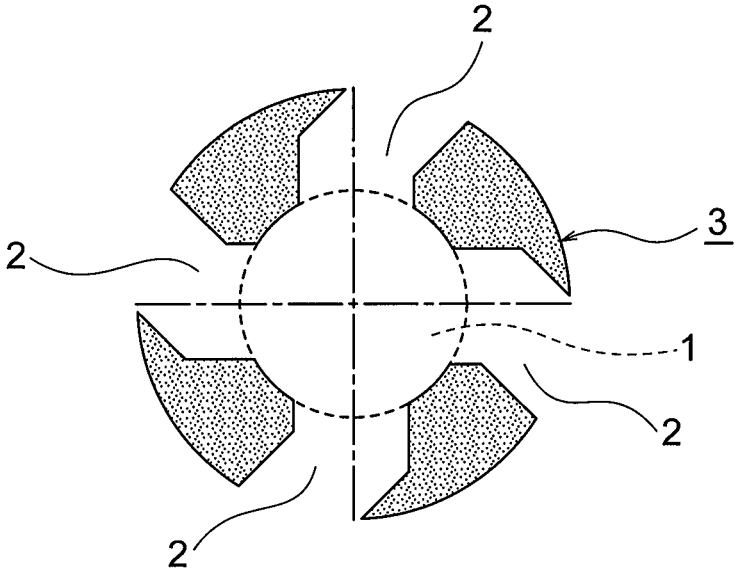
FIG. 2 is a cross-sectional schematic drawing showing only a cross-section of the nozzle hole and the discharge holes in FIG. 1.

Therefore, various shapes were investigated, and as shown in FIG. 2 it was discovered that when the discharge hole flow passages 2 are bent in a key shape which is inflected in a dog-leg shape at an intermediate point of the discharge hole flow passage 2, a rotational flow having a central axis at the submerged nozzle 3 is formed stably throughout the whole mold.

Figure 13:
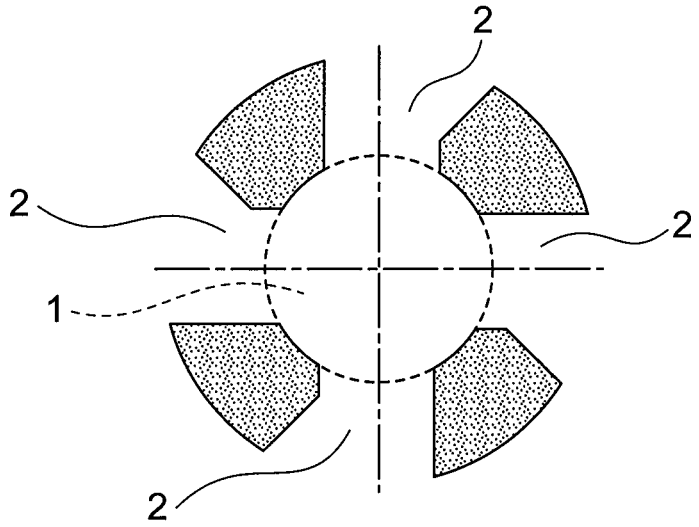
FIG. 13 is a schematic drawing showing a comparative example in which only the inner side of the discharge hole flow passage is inflected.
Figure 14:
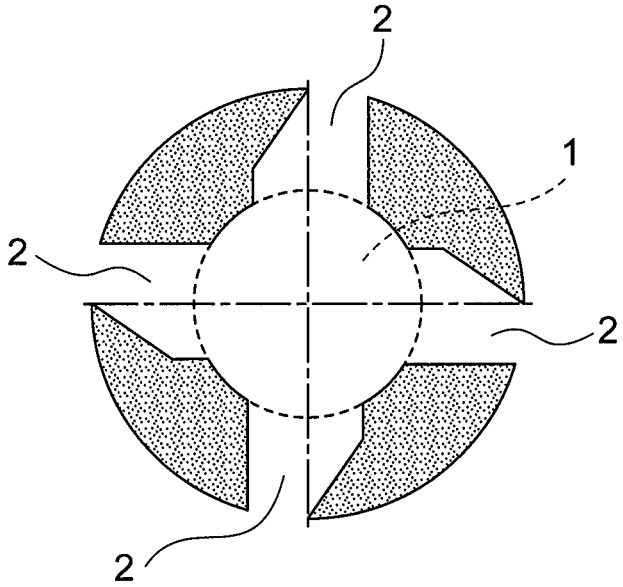
FIG. 14 is a schematic drawing showing a comparative example in which only the outer side of the discharge hole flow passage is inflected.

Moreover, experiments were carried out in which only the inner side of the discharge hole flow passage 2 was inflected as shown in FIG. 13, and in which only the outer side of the discharge hole flow passage 2 was inflected as shown in FIG. 14, but in these cases a satisfactory rotational flow was not achieved.

Figure 7:
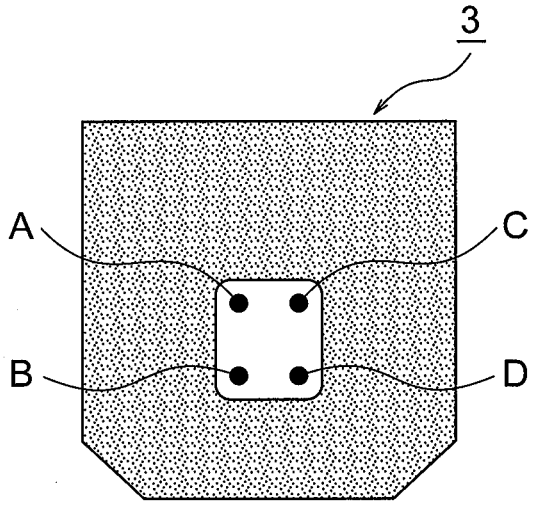
FIG. 7 is a schematic drawing showing discharge flow rate measurement positions in the discharge holes in FIG. 1, as viewed from the outer side of a discharge hole of the submerged nozzle.
Figure 8:
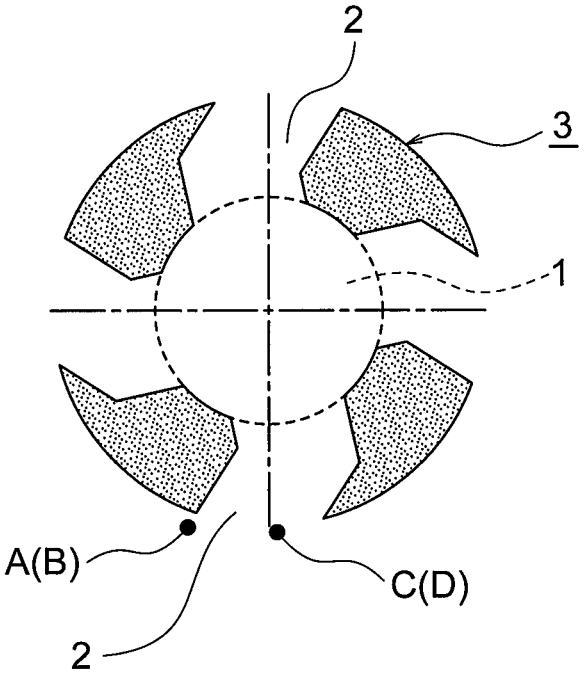
FIG. 8 is a horizontal schematic diagram showing discharge flow rate measurement positions in a lateral cross-section at the position of the discharge holes in FIG. 1.

In order to investigate the reasons why a rotational flow is generated or not generated, depending on the shape of the discharge hole flow passages 2, a propeller flow rate at measurement positions A, B, C and D was investigated to find the flow rate at respective positions in a discharge hole flow passage 2. FIG. 7 and FIG. 8 show schematic drawings indicating the measurement positions. FIG. 7 shows a state where the measurement positions are viewed from the outer side of the discharge hole flow passage 2 of the submerged nozzle 3, and FIG. 8 shows the lateral cross-section of the positions of the discharge hole flow passages 2. The measurement positions A and B are on the inner side of the discharge hole flow passage where a rotational flow is to be generated, and C and D are on the outer side.

Figure 9:
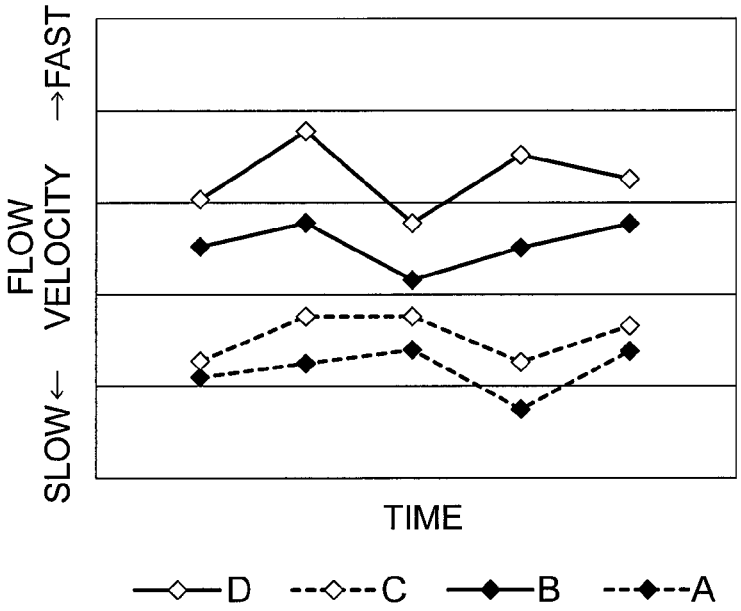
FIG. 9 is a characteristic diagram showing the discharge flow rate measurement results in the case of the discharge hole cross-section shown in FIG. 2 by which a satisfactory rotational flow is obtained.

FIG. 9 shows the measurement results for the discharge flow rate in the case of the cross-section of the discharge hole flow passage 2 in FIG. 2, by which a sufficient rotational flow is obtained. The horizontal axis represents temporal change and the vertical axis represents the relative value of the average flow rate every 10 seconds, the value being higher towards the upper side and the value being lower towards the lower side. When the flow rate in the up/down direction of the discharge hole flow passage 2 is compared, the flow rate is greater at B and D on the lower side, but this is due to the effects of the downward flow from top to bottom inside the submerged nozzle 3. On the other hand, temporal change in the flow rate is observed, but this is because the flow rate is controlled by a well-known sliding plate directly above the submerged nozzle 3, and therefore a flow with a slight bias is obtained inside the submerged nozzle 3 and the flow rate also varies. When the flow rate values in the same horizontal plane (D and B, C and A) of the discharge hole flow passage 2 are compared, the flow rate is slower on the inner sides B and A of the inflection, compared to the outer sides C and D.

Figure 10:
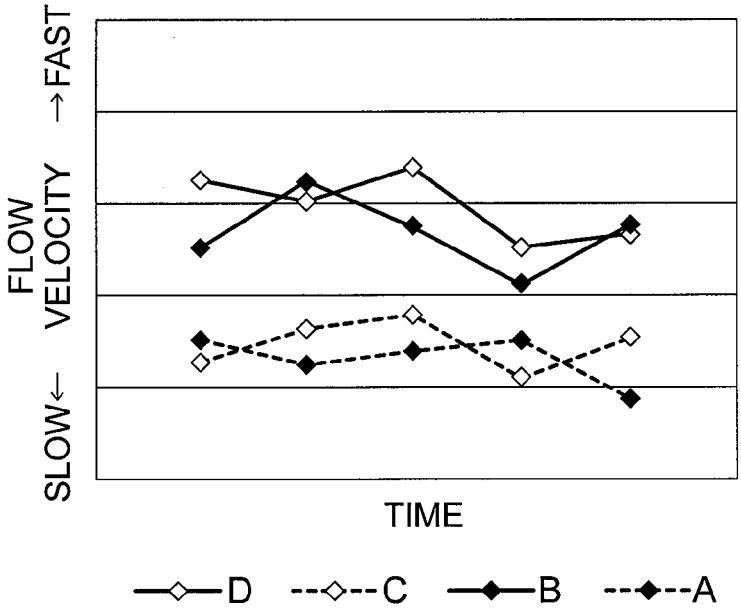
FIG. 10 is a characteristic diagram showing the discharge flow rate measurement results in the case of the discharge hole cross-section shown in FIG. 12 by which a satisfactory rotational flow is not obtained.

In relation to this, FIG. 10 shows the measurement results for the discharge flow rate in the case of the cross-section of the discharge hole flow passage 2 in FIG. 12, by which a sufficient rotational flow is not obtained. If the flow rate values in the same horizontal plane of the discharge hole flow passage 2 (D and B, C and A) are compared, there is virtually no difference between the flow rates D and C on the outer side of the discharge hole flow passage 2 and the flow rates B and A on the inner side, and a reverse transfer phenomenon is observed in which the flow rate is faster on the inner side (B, A) of the time curve. Inside the mold during the measurement, an instable state occurs in which a rotational flow repeatedly appears and disappears.

From this viewpoint, it can be seen that a sufficient rotational flow can be generated in a state where the flow on the outer side of the discharge hole flow passages 2 which is inflected or curved is large and stable, but that a sufficient rotational flow cannot be generated when the flow is instable, and it can also be seen that a rotational flow is generated when the flow passages are curved (FIG. 12 and FIG. 10) and when the flow on the outer side of the curve is large, but the rotational flow disappears if the flow becomes instable and reverses.

Figure 3:
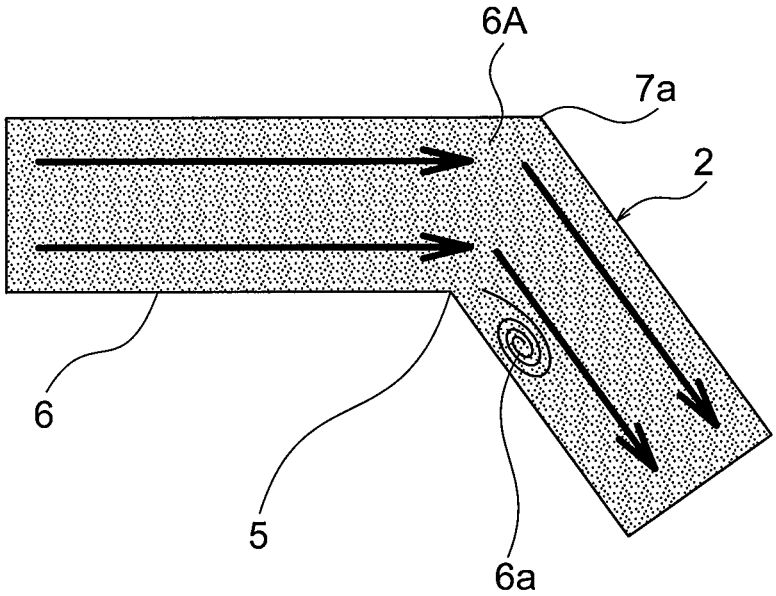
FIG. 3 is an enlarged schematic drawing of a discharge hole in FIG. 1.

This phenomenon can be regarded as being caused by the shape of the discharge hole flow passages 2. In other words, FIG. 3 is a schematic drawing showing the flow inside the flow passage when the discharge hole flow passage 2 is inflected. The B and A sides shown in FIG. 7 are the inner sides when the flow passage is inflected. If the discharge hole flow passage 2 is inflected, then a flow which separates from the passage walls, rather than flowing along the passage walls, is generated on the downstream side of the first inner surface side wall 6 from the inner side point of inflection 5. An eddy 6*a* is generated to the downstream side of the inner side point of inflection 5 due to the separation of the flow, and consequently, the flow rate to the downstream side of the inner side point of inflection 5 on the inner side of the inflection section 6A is slowed. As opposed to this, since the flow volume is uniform, the flow rate becomes faster on the outer side of the inflection section 6A, due to the decrease in the flow rate on the inside of the inflection section 6A. On the other hand, the flow on the outer side of the inflection section 6A becomes a flow which is inclined with respect to the radiating direction as viewed from the center of the submerged nozzle 3, due to the side wall on the downstream side of the outer side point of inflection 9. In this way, due to the dual effects of the increase in the flow rate on the outer side of the inflection section 6A as a result of the generation of an eddy 6*a* caused by the inner side point of inflection 5, and the directing of the flow by the outer side of the inflection section 6A, a flow inclined with respect to the radiating direction viewed from the center of the submerged nozzle 3 continues to occur in a stable fashion, as a result of which a stable rotational flow is generated.

On the other hand, in the case of the curved flow path in FIG. 12, and when separation of the flow is not likely to occur inside the curved portion and the flow on the outer side is fast due to the curved shape, a rotational flow is generated, but if the flow in the submerged nozzle 3 is disturbed, then the discharge flow will be instable and the rotational flow is lost. The same can be envisaged when the discharge hole flow passages 2 are provided in a tangential direction to the nozzle hole 1 as in FIG. 11. Moreover, if the inner side only is inflected and the outer side is not inflected, as in FIG. 13, then even if an eddy 6*a* is generated to the downstream side of the inflection section on the inner side of the flow passage, this has little effect because the outer side flow passage is a straight line, and therefore the flow direction becomes a radiating shape and a rotational flow is not generated. Furthermore, if only the outer side is inflected as shown in FIG. 14, then an eddy 6*a* is not generated and therefore a rotational flow is not generated.

The submerged nozzle for continuous casting of molten metal according to the present invention was obtained by the discoveries and analysis described above.

Figure 1:
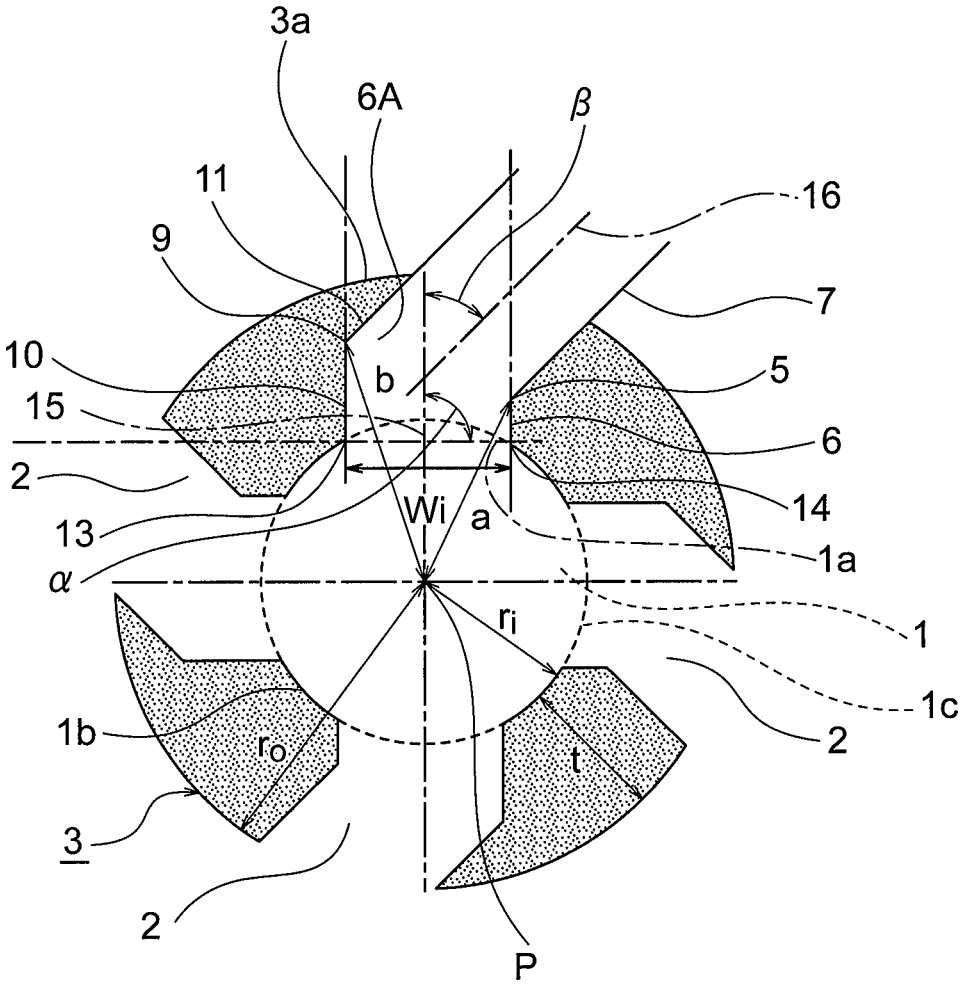
FIG. 1 is a cross-sectional schematic drawing showing a nozzle hole and discharge holes of a submerged nozzle for continuous casting of molten metal according to the present invention.

Below, a preferred mode of the submerged nozzle for continuous casting of molten metal according to the present invention will be described on the basis of FIG. 1.

Desirably, the discharge hole flow passages 2 are arranged at rotationally symmetrical positions below the submerged nozzle 3. In so doing, it is possible to continue a rotational movement by means of the flow from the discharge hole flow passages 2. Furthermore, desirably, the number of discharge hole flow passages 2 is two to four, but the number may also be greater than this.

The most important technical feature of the present invention is that a structure is adopted in which the discharge hole flow passages 2 are inflected rather than curved at the inner side point of inflection 5, and a stagnating section occurs due to the flow separating from the wall surfaces. Therefore, desirably, the two side surfaces of the discharge hole flow passages 2 in the horizontal cross-section of the submerged nozzle 3 when in use are constituted substantially by straight lines that are inflected. By inflecting the first and second inner surface side walls 6 and 7 on the inner surface side, an eddy 6*a* is created on the downstream side from the inner side point of inflection 5, and the flow rate on the outer side of the flow passage can be raised. Furthermore, by inflecting the first and second outer surface side walls 10 and 11 on the outer surface side, it is possible to direct the flow in a direction that is inclined with respect to the radiating direction as viewed from the center of the nozzle hole 1, and a rotational flow can therefore be created. By combining these inflections, a stable rotational flow is created.

Consequently, in order to generate a rotational flow in the mold, it is necessary to generate a constant bias in the flow rate inside the discharge hole flow passage 2, and therefore, it is important that the walls on both sides of the flow passage 2 should be inflected in the same direction and that the angle of inflection should be within a certain prescribed range. If only the inside is inflected and the opposite side is a straight line as shown in FIG. 13, the flow passes along the straight-line wall surface and is discharged in a substantially radiating fashion from the nozzle hole 1, and therefore a rotational flow cannot be generated inside the mold. Furthermore, if only the outer side is inflected, as in FIG. 14, then it is not possible to generate a sufficient rotational flow inside the mold.

The inner side point of inflection 5 of the discharge hole flow passage 2, and the outer side point of inflection 9 may be provided with a small curved radius R in order to simplify the manufacturing process. On the inner side, in particular, if the curve R is too great, then the shape approaches a curved flow passage rather than an inflected flow passage, and it becomes impossible to obtain a sufficient rotational flow. More specifically, R is no more than 5 mm, and desirably, no more than 3 mm. Furthermore, the inner and outer sides may have different values of the curve R.

The second angle β which is formed between a first center line 15 between the two straight lines, and extension lines thereof, formed by the first inner surface side wall 6 and the first outer surface side wall 10 on the inner side of the submerged nozzle 3 from the inflection section 6A in the discharge hole flow passage 2, and a second center line 16 between the two straight lines, and extension lines thereof, formed by the second inner surface side wall 7 and the second outer surface side wall 11 on the outer side of the submerged nozzle 3 from the inflection section 6A, is desirably 15 to 85°, and more desirably 25 to 75°. If the second angle β is less than 15°, then a flow separating from the tube wall does not occur in the flow passage on the inner side of the inflection, and therefore in addition to not being able to achieve a sufficient flow rate differential inside the flow passage, the flow is discharged in a substantially radiating fashion from the center of the nozzle, and hence a rotational flow inside the mold is not achieved. On the other hand, if the second angle β is greater than 85°, then the rotational flow rate decreases. This is thought to be because the growth of the eddy generated on the inner surface side becomes too large, and increase in flow rate on the outer side is suppressed. Furthermore, since the material thickness of the second outer surface side wall 11 and the nozzle outer surface 3*a* is thin, then problems of cracking and detachment of the submerged nozzle 3 during use become liable to occur when an angle greater than the above angle is implemented.

Desirably, the first angle α between the straight line 1*a* which links a pair of first and second intersection points 13 and 14 where the nozzle hole 1 intersects with two straight lines formed by the first inner surface side wall 6 and the first outer surface side wall 10 on the inner side of the submerged nozzle 3 from the inflection section 6A, and the first center line 15 which passes through the hole center P between the two straight lines formed by the first inner surface side wall 6 and the first outer surface side wall 10 on the inside of the submerged nozzle 3 from the inflection section 6A, is 45 to 135°. More desirably, the first angle α is 50 to 120°. If the first angle α is less than 45°, or greater than 135°, then the wall thickness between the nozzle hole 1 and the discharge hole flow passage 2 becomes thinner, and manufacture becomes difficult.

The distance Wi between the pair of first and second intersection points 13 and 14 where the two straight lines formed by the first inner surface side wall 6 and the first outer surface side wall 10 on the inner side of the submerged nozzle 3 from the inflection section 6A intersect with the nozzle hole 1 is desirably $0.15 \geq Wi/ri \geq 1.6$, and more desirably, $0.2 \geq Wi/ri \geq 1.4$, where ri is the radius of the nozzle hole 1. If Wi/ri is less than 0.15, then this is not desirable since the discharge hole flow passage 2 becomes too small and the flow volume cannot be guaranteed, and if Wi/ri is greater than 1.6, then the material thickness at the nozzle outer surface 3*a* becomes thin, and therefore problems such as cracks and detachment of the submerged nozzle 3 during use become more liable to occur, which is undesirable.

Taking the thickness of the submerged nozzle 3 to be t, the radius of the nozzle hole 1 to be ri, and the distance from the center of the submerged nozzle 3 to the inner side point of inflection 5 to be a, then desirably (a−ri)/t is no less than 0.2, and more desirably, no less than 0.3.

If (a−ri)/t is less than 0.2, then the flow from the nozzle hole 1 of the submerged nozzle 3 to the discharge hole flow passage 2 is insufficient, and therefore the eddy on the downstream side from the points of inflection 5 and 9 does not grow sufficiently. Therefore, a sufficient rotational flow is not obtained. The maximum value of (a−ri)/t is not specified in particular, and is determined in accordance with the shape of the discharge hole flow passages 2 which is described below.

On the other hand, if the distance from the center of the nozzle hole 1 to the outer side point of inflection 9 on the outer side surface of the inflection section is taken to be b, then (b−ri)/t is desirably no more than 0.9 and more desirably, no more than 0.85. If the distance b is greater than 0.9, then this is undesirable, since a sufficient effect cannot be obtained in causing the flow on the outer side of the inflection section to become inclined with respect to the radiating direction as viewed from the center of the nozzle hole 1, by means of the side wall on the downstream side of the outer side point of inflection 9.

The width of the discharge hole flow passage 2 is essentially uniform, but does not have to be uniform. More specifically, the width on the inner side from the outer side point of inflection 9 may vary, and may be larger at the inlet to the discharge hole flow passage 2, and smaller on the side of the inflection section 6A, or alternatively larger on the side of the inflection section 6A. Furthermore, the width may also vary similarly to the outer side from the inner side point of inflection 5. Moreover, the width may also vary before and behind the inflection section 6A.

Figure 15:
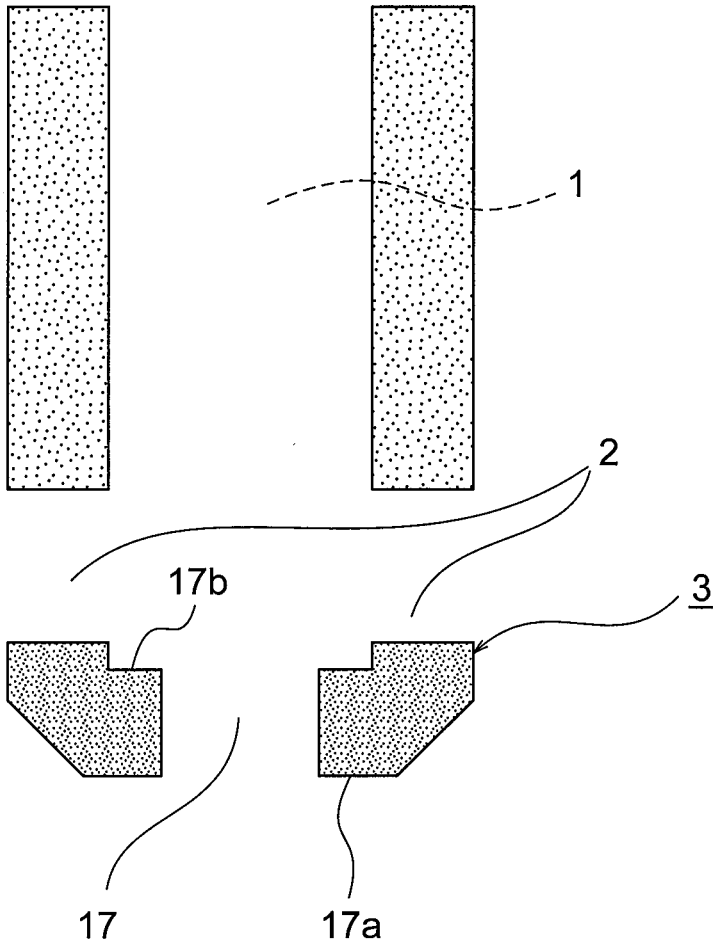
FIG. 15 is a schematic drawing showing a case where a bottom hole is formed on the bottom of the nozzle, in a further mode of FIG. 1.

In addition to providing discharge hole flow passages 2 in the side surfaces of the submerged nozzle 3, as described in FIG. 15, a bottom hole 17 may also be provided in the bottom surface of the nozzle.

Due to the relationship between the cross-sectional area of the mold, and the passed volume of molten steel inside the submerged nozzle 3, if the passed volume of molten steel inside the submerged nozzle 3 is large and the discharge flow from the discharge hole flow passages 2 provided in the side surfaces is too great compared to the cross-sectional area of the mold, then the discharge flow generating a rotational flow becomes too strong, the meniscus vibration becomes large, and the casting process becomes instable. In this case, a bottom hole 17 is provided, and the flow volume required to create a rotational flow is caused to flow out from the discharge hole flow passages 2 on the side surfaces, while the remaining flow of molten steel is introduced to the downstream side of the mold, from the bottom hole 17, thereby achieving both a stable rotational state, and the suppression of meniscus vibrations.

If the hole opening surface area of the bottom hole 17 is $S_b$ and the total opening surface area which is the sum of the opening surface area of the discharge hole flow passages 2 provided in the side surfaces and the opening surface area of the bottom hole 17 is $S_t$, then the larger the value of the relative molten steel outflow volume $S_b/S_t$ from the bottom hole 17, the greater the ratio of the molten steel volume flowing out from the bottom hole 17 with respect to the passed volume of molten steel in the nozzle. Furthermore, desirably, $S_b/S_t$ is 0 to 0.4. More desirably, $S_b/S_t$ is 0.1 to 0.35.

Essentially, the cross-sectional shape of the bottom hole 17 in the direction parallel to the walls 17*a* of the bottom hole is circular, but it may also be a polygonal shape. Moreover, if the shape in the cross-sectional direction perpendicular to the bottom hole walls 17*a* forms a straight line, a curve or a combination of a plurality of straight lines and curves, it is possible to select a shape which is convex in the center.

Furthermore, although not illustrated in the drawings, it is also possible to form a plurality of bottom holes 17. In this case, the value $S_b$ is the sum of the surface areas of the bottom holes 17. Furthermore, it is also possible to incline the discharge directions of a plurality of bottom holes 17 with respect to the nozzle axis, and to provide the bottom holes 17 in such a manner that the discharge directions thereof do not intersect with the nozzle axis.

The shape of the mold in which the submerged nozzle 3 according to the present invention is used may be a round billet, a square billet, or bloom, having a diameter or long dimension of no more than 600 mm in the horizontal cross-section, and the passed molten steel volume is suitably in a range of 0.3 to 2.0 ton/min. Provided that the mold shape is close to a rectangular shape or circular shape, then a rotational flow is generated in the whole mold, but in the case of shapes with very long edges, such as a slab, although a good rotational flow is transmitted to the periphery of the nozzle, it is difficult to generate a rotational flow in the range of the shorter edge walls of the mold, which are distant from the nozzle. Considered in terms of the passed molten steel volume, with a low flow volume of no less than 0.3 ton/min, the discharge flow rate is very gentle and only an unsatisfactory rotational flow is generated. On the other hand, with a high flow rate of no less than 2.0 ton/min, great disruption is caused by the meniscus vibrations, and therefore the flow becomes instable.

The submerged nozzle 3 according to the present invention relates to the shape of the discharge hole flow passages 2, and there are no restrictions on the structure of the nozzle hole 1 or the nozzle material. With regard to the structure of the nozzle hole 1, similar beneficial effects are obtained, for example, with a generic straight tube structure, and a structure wherein the diameter changes partially at an intermediate point of the tube, and a structure having recesses and projections in the inner tube. The nozzle material may be alumina-graphite, or magnesia-graphite, spinel-graphite, zirconia-graphite, alumina, clay, spinel, fused quartz, or the like. Even if the discharge hole flow passages 2 have an upwardly inclined angle or a downwardly inclined angle with respect to the horizontal plane, beneficial effects similar to those obtained when they are horizontal can be obtained.

Practical Examples and Comparative Examples

A water model simulation apparatus of a similar scale to actual equipment was used to evaluate whether or not a stable rotational flow could be achieved using the submerged nozzles 3 indicated in Table 1.

The water model of the submerged nozzle 3 was a water model envisaging a continuous casting apparatus for a 200 mm-diameter round billet, wherein the submerged nozzle 3 has an inner diameter of 35 mm, an outer diameter of 75 mm, a material thickness of 20 mm, an output cross-section of the discharge hole of 24 mm×22 mm, two discharge holes, and a casting draw rate of 1.5 m/minute.

The rotational flow was evaluated as indicated below. More specifically, an experiment was carried out for three minutes, and the occurrence of a steady rotational flow inside the mold during this time was assessed on the basis of the rate and stability of the rotational flow. The rotational flow rate was judged to be "satisfactory" if sufficiently large, was judged to be "rather unsatisfactory" if a rotational flow occurred but it was not very large, and was judged "none" if a rotational flow did not occur. Furthermore, stability was judged to be "good" when a stable rotational flow was obtained, was judged to be "instable" if the rotational flow repeatedly appeared and disappeared, and was judged "none" if the rotational flow did not occur.

The water model experiment was carried out using various shapes of the discharge hole flow passage 2, and the characteristic features thereof were as follows.

In cases where there was an inflection point at an intermediate point of the flow channel, a radius of R5 was applied in all cases. Table 1 shows the experiment results. The characteristics of the respective discharge hole shapes are expressed below.

1. Tangential: The shape described in documents 1 to 4 and illustrated in FIG. 11 in which the discharge hole path is formed by straight lines in a tangential direction to the inner diameter.
2. Curved: The shape described in documents 1 and 3 and illustrated in FIG. 12, in which the discharge hole path is curved when viewed in the perpendicular direction during use.
3. Inside-only inflected: The shape illustrated in FIG. 13 in which the side walls of the discharge hole path are inflected on the inner side only, and the opposite side is formed by a straight line.

4. Outside-only inflected: The shape illustrated in FIG. 14 in which the side walls of the discharge hole path are inflected on the outer side only, and the opposite side is formed by a straight line.

5. Inflected: The shape illustrated in FIG. 2 in which both side walls of the discharge hole flow passage 2 are inflected in the same direction at an intermediate point.

In the case of the tangential shape described in Documents 1 to 4 and the curved shape described in Documents 1 and 3, the flow rate of the rotational flow was weak, and therefore the rotational flow repeatedly appeared and disappeared, and the mold was in an instable state (Comparative Examples 1 and 2). When only the inner side of the discharge hole path was inflected (Comparative Examples 3 to 5), or when only the outer side thereof was inflected (Comparative Examples 6 to 9), a rotational flow did not occur. With a shape where both sides of the discharge hole flow passage 2 were inflected in the same direction, where β was 15 to 85°, and where the distances a and b from the nozzle center to the points of inflection 5 and 9 were respectively in ranges of $0.2 \geq (a-ri)/t$ and $(b-ri)/t \geq 0.9$, then a stable rotational flow was obtained with a sufficient flow rate (Products of the Invention 1 to 7), but if β was within the stated range but the distance to the points of inflection was outside the stated range (Comparative Examples 10, 12, and 13), or if β was outside the stated range (Comparative Examples 11, 14, and 15), then although a stable rotational flow occurred, the rotational flow was not very large.

Figure 4:
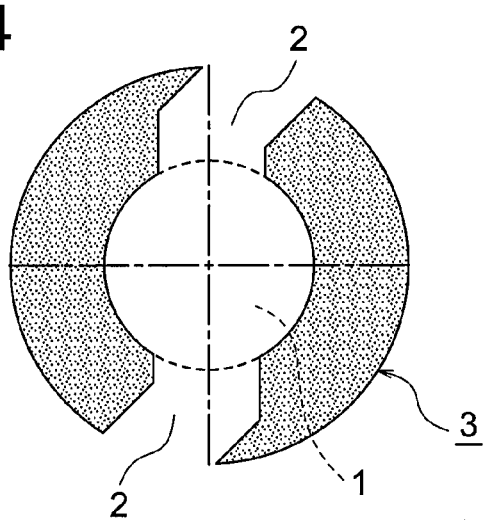
FIG. 4 is a schematic drawing showing a composition of a pair of discharge holes according to a further mode of FIG. 1.
Figure 5:
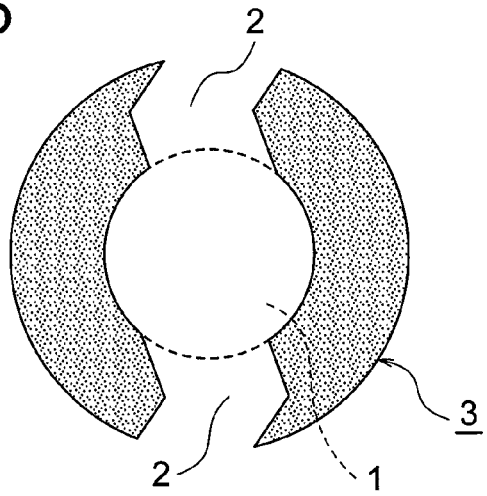
FIG. 5 is a schematic drawing showing a composition of a pair of discharge holes according to a further mode of FIG. 1.
Figure 6:
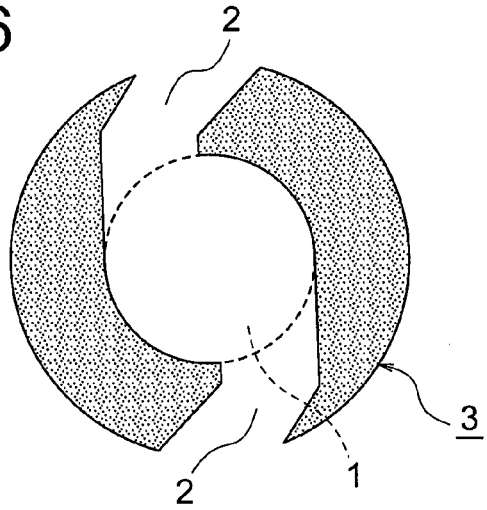
FIG. 6 is a schematic drawing showing a composition of a pair of discharge holes according to a further mode of FIG. 1.

Next, in order to confirm the state of generation of the rotational flow due to the mold shape, the submerged nozzles 3 according to the Product of the Invention 1 and the Comparative Example 1 of the present invention were used in an actual casting machine and the beneficial effects thereof were confirmed. FIG. 4 shows a cross-sectional diagram of the Product of the Invention 1, and Table 2 shows the test results. In the Comparative Examples, a sufficient rotational state could not be obtained, but when the Product of Invention 1 was used, it was possible to obtain a good rotational state, regardless of the size and shape of the mold.

TABLE 2

| | Comparative Example 1 | Product of Invention 1 | Product of Invention 1 | Product of Invention 1 |
|---|---|---|---|---|
| α | 52.5 | | 52.5 | |
| β | — | | 30 | |
| (a-ri)/t | | | 0.21 | |
| (b-ri)/t | | | 0.74 | |
| t | 20 | | 20 | |
| Wi | 22 | | 22 | |
| Shape of mold | Bloom | Bloom | Round billet | Square billet |
| Dimension of long edge (diameter) (mm) | 500 | 500 | 300 | 300 |

TABLE 1

| | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 | Comp. Ex. 9 | Product Invention 1 | Product Invention 2 |
|---|---|---|---|---|---|---|---|---|---|---|---|
| Feature of hole shape | Tangential | Curved | Inside-only inflected | | | Outside-only inflected | | | | Inflected | |
| α | 52.5 | 52.5 | 90 | 90 | 90 | 52.5 | 52.5 | 90 | 90 | 52.5 | 52.5 |
| β | — | — | 30 | 30 | 60 | 30 | 45 | 30 | 45 | 30 | 45 |
| (a-ri)/t | | | 0.4 | 0.8 | 0.5 | — | — | — | — | 0.21 | 0.23 |
| (b-ri)/t | | | — | — | — | 0.6 | 0.8 | 0.7 | 0.7 | 0.74 | 0.87 |
| t | 20 | 20 | 20 | 20 | 20 | 20 | 20 | 20 | 20 | 20 | 20 |
| Wi | 22 | 22 | 22 | 22 | 22 | 22 | 22 | 22 | 22 | 22 | 22 |
| State of rotational flow | Unsatis-factory | Unsatis-factory | None | None | None | None | None | None | None | Good | Good |
| Stability of rotational flow | Instable | Instable | None | None | None | None | None | None | None | Good | Good |

| | Comp. Ex. 10 | Comp. Ex. 11 | Comp. Ex. 12 | Product Invention 3 | Product Invention 4 | Comp. Ex. 13 | Comp. Ex. 14 | Product Invention 5 | Product Invention 6 | Product Invention 7 | Comp. Ex. 15 |
|---|---|---|---|---|---|---|---|---|---|---|---|
| Feature of hole shape | | | | | | Inflected | | | | | |
| α | 52.5 | 90 | 90 | 90 | 90 | 90 | 142.5 | 142.5 | 142.5 | 142.5 | 142.5 |
| β | 60 | 10 | 30 | 30 | 60 | 80 | 10 | 30 | 60 | 80 | 90 |
| (a-ri)/t | 0.12 | 0.44 | 0.05 | 0.36 | 0.27 | 0.08 | 0.67 | 0.62 | 0.47 | 0.32 | 0.20 |
| (b-ri)/t | 0.93 | 0.61 | 0.33 | 0.70 | 0.84 | 0.92 | 0.59 | 0.66 | 0.81 | 0.86 | 0.86 |
| t | 20 | 20 | 20 | 20 | 20 | 20 | 20 | 20 | 20 | 20 | 20 |
| Wi | 22 | 22 | 22 | 22 | 22 | 22 | 22 | 22 | 22 | 22 | 22 |
| State of rotational flow | Unsatis-factory | Unsatis-factory | Unsatis-factory | Good | Good | Unsatis-factory | Unsatis-factory | Good | Good | Good | Unsatis-factory |
| Stability of rotational flow | Good | Good | Good | Good | Good | Good | Good | Good | Good | Good | Good |

TABLE 2-continued

| | Comparative Example 1 | Product of Invention 1 | Product of Invention 1 | Product of Invention 1 |
|---|---|---|---|---|
| Flow rate of rotational flow | Unsatisfactory | Good | Good | Good |
| Stability of rotational flow | Unsatisfactory | Good | Good | Good |

Furthermore, a water model simulation test was carried out in order to check the state of generation of the rotational flow depending on the through-put. A nozzle having the shape of the Product of the Invention 1 was used, and the mold size was a square shape of 500×500 mm. Table 3 shows the results.

Under all through-put conditions, a rotational flow was generated, but when the through-put was 0.2 ton/min, the rotational flow rate was slow and unsatisfactory. At through-puts of 0.4 and 1.8 ton/min, a good rotational state was obtained, but at 2.2 ton/min, the meniscus vibration was severe, and an instable state occurred.

TABLE 3

| | | | | |
|---|---|---|---|---|
| α | 52.5 | | | |
| β | 30 | | | |
| (a-ri)/t | 0.21 | | | |
| (b-ri)/t | 0.74 | | | |
| t | 20 | | | |
| Wi | 22 | | | |
| Through-put (ton/min) | 0.2 | 0.4 | 1.8 | 2.2 |

TABLE 3-continued

| | | | | |
|---|---|---|---|---|
| Dimension of long edge (mm) | 500 | 500 | 500 | 500 |
| Flow rate of rotational flow | Unsatisfactory | Good | Good | Good |
| Stability of rotational flow | Good | Good | Good | Unsatisfactory |

A water model simulation test was carried out under similar conditions, in order to check the beneficial effects of providing a bottom hole 17. A plurality of submerged nozzles 3 having the shape according to the first embodiment of the present invention were prepared, and a round hole was provided in the bottom portion of the submerged nozzles 3. For comparison, a test was carried out with a nozzle provided only with a bottom hole 17. The mold size was taken to be a 500 by 500 mm square shape. In addition to the assessment items in the respective water model simulation tests described above, the amount of variation in the in-mold bath surface was also assessed. Table 4 shows the results. Although a rotational flow was generated under all through-put conditions, a tendency for increased variation in the in-mold bath surface was observed under high through-put conditions. When a bottom hole was provided, a favorable state was obtained in which the generation and stability of the rotational flow remained unchanged, but the amount of variation in the bath surface was suppressed. In a nozzle with a bottom hole 17 only (Comparative Example 16), no rotational flow was generated, and if the bottom hole 17 was too large, then there was a tendency for the rotational flow to be weak.

TABLE 4

| | Experiment 1 Product of Invention 1 | Experiment 2 Product of Invention 1 | Experiment 3 Product of Invention 1 | Experiment 4 Product of Invention 1 | Experiment 5 Product of Invention 8 | Experiment 6 Product of Invention 8 | Experiment 7 Product of Invention 8 | Experiment 8 Product of Invention 8 | Experiment 9 Product of Invention 9 | Experiment 10 Product of Invention 9 |
|---|---|---|---|---|---|---|---|---|---|---|
| Inflow volume (ton/min) | 0.5 | 1 | 2 | 3 | 0.5 | 1 | 2 | 3 | 0.5 | 1 |
| Sbottom/Stotal | 0 | 0 | 0 | 0 | 0.1 | 0.1 | 0.1 | 0.1 | 0.4 | 0.4 |
| State of rotational flow | Good | Good | Good | Good | Good | Good | Good | Good | Good | Good |
| Stability of rotational flow | Good | Good | Good | Instable | Good | Good | Good | Good | Good | Good |
| Variation in bath surface in mold | Good | Good | Quite rough | Rough | Good | Good | Good | Quite rough | Good | Good |

| | Experiment 11 Product of Invention 9 | Experiment 12 Product of Invention 9 | Experiment 13 Product of Invention 10 | Experiment 14 Product of Invention 10 | Experiment 15 Product of Invention 10 | Experiment 16 Product of Invention 10 | Experiment 17 Comparative Example 16 | Experiment 18 Comparative Example 16 |
|---|---|---|---|---|---|---|---|---|
| Inflow volume (ton/min) | 2 | 3 | 0.5 | 1 | 2 | 3 | 1 | 2 |
| Sbottom/Stotal | 0.4 | 0.4 | 0.5 | 0.5 | 0.5 | 0.5 | 1 | 1 |
| State of rotational flow | Good | Good | Occurred | Occurred | Occurred | Occurred | None | None |

TABLE 4-continued

| | | | | | | | | |
|---|---|---|---|---|---|---|---|---|
| Stability of rotational flow | Good | Good | Instable | Good | Good | Good | — | — |
| Variation in bath surface in mold | Good | Quite rough | Good | Good | Good | Good | Good | Good |

INDUSTRIAL APPLICABILITY

The submerged nozzle for a continuous casting apparatus according to the present invention can contribute to improvement of the quality of cast metal, by generating a stable rotational flow of molten steel inside a mold simply by improving the shape of discharge holes of the submerged nozzle, without making modifications to other equipment.

The invention claimed is:

1. A submerged nozzle for continuous casting of molten metal, wherein two or more discharge hole flow passages are provided on a cylindrical side surface of a submerged nozzle having a nozzle hole, and first and second inner surface side walls and first and second outer surface side walls of the discharge hole flow passages in a horizontal cross-section of the submerged nozzle when in use are composed by straight lines formed so as to be inflected at an inner side point of inflection and an outer side point of inflection, wherein the discharge hole flow passages in the horizontal cross-section of the submerged nozzle when in use are composed by straight lines formed so as to be inflected at the outer side point of inflection and an angle β of 15° to 85°, wherein the angle β is formed between a first center line between the two straight lines, and extension lines thereof, formed by the first inner surface side wall and the first outer surface side wall on the inner side of the submerged nozzle from the inflection section in the discharge hole flow passage, and a second center line between the two straight lines, and extension lines thereof, formed by the second inner surface side wall and the second outer surface side wall on the outer side of the submerged nozzle from the inflection section.

2. The submerged nozzle for continuous casting of molten metal according to claim 1, wherein a further angle α, which is formed between a straight line that links first and second intersection points where an outer edge of the nozzle hole intersects with two straight lines formed by the first inner surface side wall and the first outer surface side wall on the inner side of the discharge hole flow passages of the submerged nozzle, and a first center line, which intersects with the straight line and passing through a hole center of the nozzle hole, is 45° to 135°.

3. The submerged nozzle for continuous casting of molten metal according to claim 1, wherein, when a thickness of the submerged nozzle is t, a distance from the hole center of the nozzle hole to the inner side point of inflection is a, a distance from the hole center to the outer side point of inflection is represented by b, and ri is the radius of the nozzle hole, then $$0.2 \leq (a-ri)/t \text{ and } (b-ri)/t \leq 0.9$$

are established.

4. A submerged nozzle for continuous casting of molten metal, wherein two or more discharge hole flow passages are provided on a cylindrical side surface of a submerged nozzle having a nozzle hole, and first and second inner surface side walls and first and second outer surface side walls of the discharge hole flow passages in a horizontal cross-section of the submerged nozzle when in use are composed by straight lines formed so as to be inflected at an inner side point of inflection and an outer side point of inflection, wherein a circular or polygonal bottom hole is provided in a nozzle bottom of the submerged nozzle, and when an opening surface area of the bottom hole is $S_b$, and a total opening surface area which is the sum of an opening surface area of the discharge hole flow passages and the opening surface area of the bottom hole is $S_t$, then $S_b/S_t$ is 0 to 0.4 is established.

5. The submerged nozzle for continuous casting of molten metal according to claim 2, wherein, when a thickness of the submerged nozzle is t, a distance from the hole center of the nozzle hole to the inner side point of inflection is a, a distance from the hole center to the outer side point of inflection is represented by b, and ri is the radius of the nozzle hole, then $$0.2 \leq (a-ri)/t \text{ and } (b-ri)/t \leq 0.9$$

are established.

6. The submerged nozzle for continuous casting of molten metal according to claim 2, wherein a circular or polygonal bottom hole is provided in a nozzle bottom of the submerged nozzle, and when an opening surface area of the bottom hole is $S_b$, and a total opening surface area which is the sum of an opening surface area of the discharge hole flow passages and the opening surface area of the bottom hole is $S_t$, then $S_b/S_t$ is 0 to 0.4 is established.

7. The submerged nozzle for continuous casting of molten metal according to claim 3, wherein a circular or polygonal bottom hole is provided in a nozzle bottom of the submerged nozzle, and when an opening surface area of the bottom hole is $S_b$, and a total opening surface area which is the sum of an opening surface area of the discharge hole flow passages and the opening surface area of the bottom hole is $S_t$, then $S_b/S_t$ is 0 to 0.4 is established.

8. The submerged nozzle for continuous casting of molten metal according to claim 1, wherein the angle β is 25° to 75°.

* * * * *